US008024893B2

(12) United States Patent
Gillen

(10) Patent No.: US 8,024,893 B2
(45) Date of Patent: Sep. 27, 2011

(54) POWERED SLIDER DRIVE INTERFACE AND DRIVE ASSEMBLY

(75) Inventor: John H. Gillen, Ottawa Lake, MI (US)

(73) Assignee: Pilkington North America, Inc., Toledo, OH (US)

( * ) Notice: Subject to any disclaimer, the term of this patent is extended or adjusted under 35 U.S.C. 154(b) by 1750 days.

(21) Appl. No.: 10/781,395

(22) Filed: Feb. 18, 2004

(65) Prior Publication Data

US 2004/0163315 A1 Aug. 26, 2004

Related U.S. Application Data

(60) Provisional application No. 60/448,502, filed on Feb. 19, 2003.

(51) Int. Cl.
*E05F 11/00* (2006.01)

(52) U.S. Cl. ..... 49/360

(58) Field of Classification Search ..... 49/360, 49/352

See application file for complete search history.

(56) References Cited

U.S. PATENT DOCUMENTS 5,146,712 A 9/1992 Hlavaty
5,201,144 A 4/1993 Krajenke
5,531,046 A 7/1996 Kollar et al.
5,669,181 A 9/1997 Kollar et al.
5,694,717 A * 12/1997 Gier ..... 49/352
5,822,922 A 10/1998 Grumm et al.
5,826,377 A * 10/1998 Simson et al. ..... 49/362
6,026,611 A 2/2000 Rolston et al.
6,119,401 A 9/2000 Lin et al.
6,125,585 A 10/2000 Koneval et al.
6,324,788 B1 12/2001 Koneval et al.
6,435,636 B1 * 8/2002 MacMillan ..... 312/334.46

FOREIGN PATENT DOCUMENTS

FR 2 782 008 A 6/1996

* cited by examiner

*Primary Examiner* — Jerry Redman
(74) *Attorney, Agent, or Firm* — Marshall & Melhorn, LLC

(57) ABSTRACT

A vehicular, powered slider drive interface and drive assembly are provided. The interface has a driver bracket, which includes contact surfaces, mounted on a regulator, a driver receiver, which includes contact surfaces, mounted on a slider panel, and separate bumpers disposed on each driver surface. When the regulator is caused to move in an open direction, a first driver contact surface is brought into selectively non-attached pushing or pulling mechanical contact with a first driver bumper to smoothly open the slider-panel. When the regulator is caused to move in a closed direction, a second driver contact surface is brought into selectively non-attached pushing or pulling mechanical contact with a second receiver bumper to smoothly close the slider panel. Since the driver bracket and the driver receiver are not rigidly/directly mechanically attached, the slider panel slides freely without binding and requiring precise alignment of the drive interface.

16 Claims, 6 Drawing Sheets

POWERED SLIDER DRIVE INTERFACE AND DRIVE ASSEMBLY

RELATED APPLICATIONS

This application claims the benefit of U.S. Provisional Patent Application Serial No. 60/448,502, filed Feb. 19, 2003, which application is incorporated herein in its entirety.

BACKGROUND OF THE INVENTION

The present invention generally relates to a vehicular, powered slider drive assembly and, in particular, to a vehicular, powered slider drive interface.

Pickup trucks and other related vehicles have a rear window, or backlite, that is mounted in a vehicle body aperture, immediately behind the seats in the vehicle passenger compartment. Many of the backlites are built with one or two sliding panels that ride in slider tracks, while opening or closing across a portion of a window aperture.

The sliding panels may be moved manually or automatically across the window aperture. When automatically driven, the sliding panels may be moved by, for example, a powered slider drive assembly that includes a cable having a regulator attached to at least one cable end, wherein the regulator may have brackets that are rigidly mounted to mating braces that are attached to the sliding panel's bottom corners (see, for example, U.S. Pat. No. 6,119,401 to Lin et al.)

Another automatic powered slider drive assembly utilized to slide sliding panels requires a bracket that is attached to the regulator, to rigidly mount the regulator to the bottom of the panel (see, for example, U.S. Pat. No. 6,324,788 to Koneval et al.) These rigidly mounted brackets and braces comprise at least a portion of the vehicular, powered slider drive interface.

Because of the above-stated rigid mounting, these known interfaces require that the alignment between the panel in the slider tracks and the regulator, the cable, the cable brackets, and/or the panel braces be precise. If this precision is not attained initially, and then maintained after installation, the panel will become "cocked" which causes the sliding panel to bind in the slider tracks.

Thus, those skilled in the art continued to seek a solution to the problem of how to provide a better vehicular, powered slider drive interface and drive assembly.

SUMMARY OF THE INVENTION

A vehicular, powered slider drive interface and drive assembly are provided. The powered slider drive interface comprises a slider panel, a regulator, at least first and second mechanical stops mounted on the slider panel or the regulator, both first and second stops having a contact surface, and one or more mechanical stops mounted on the other of the slider panel or the regulator, the one or more stops having third and fourth contact surfaces. When the regulator is caused to move in a first direction, the first stop's contact surface is brought into mechanical contact with the third contact surface, thus urging the slider panel into an open position. When the regulator is caused to move in a second direction, the second stop's contact surface is brought into mechanical contact with the fourth contact surface, thus urging the slider panel into a closed position.

The power slider drive assembly comprises the power slider drive interface, wherein the regulator is disposed on a powered slider frame, the regulator has a cable, or other like means, attached thereto, the cable is in mechanical communication with a power slider controller, and the slider panel is disposed in slider tracks that are positioned above and below the slider panel.

Further objects and advantages of the present invention will be apparent from the following description and appended claims, reference being made to the accompanying drawings forming a part of a specification, wherein like reference characters designate corresponding parts of several views.

DESCRIPTION OF THE PREFERRED EMBODIMENT

Figure 1:
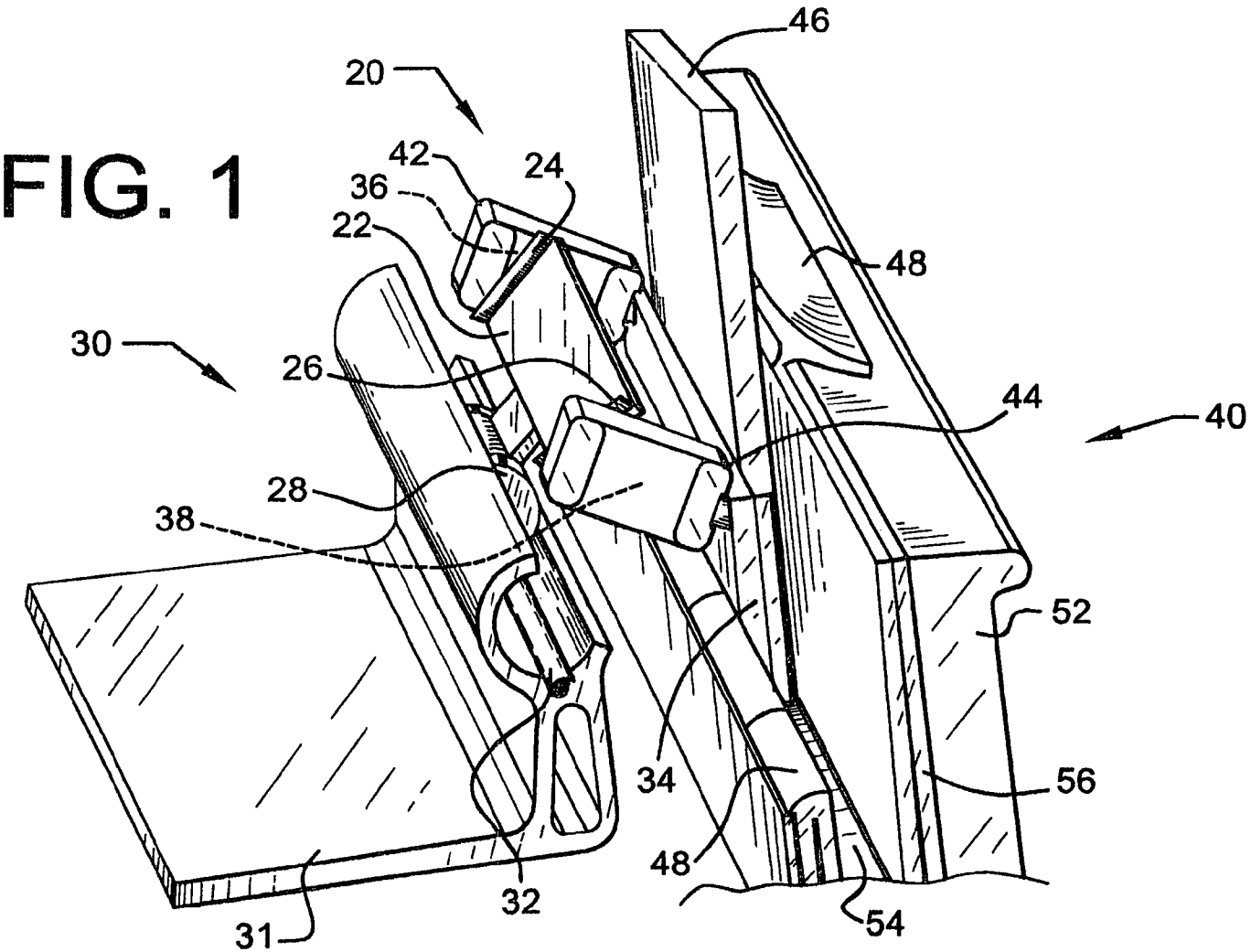
FIG. 1 is a perspective view of a vehicular, powered slider drive interface and drive assembly in accordance with the present invention.
Figure 2A:
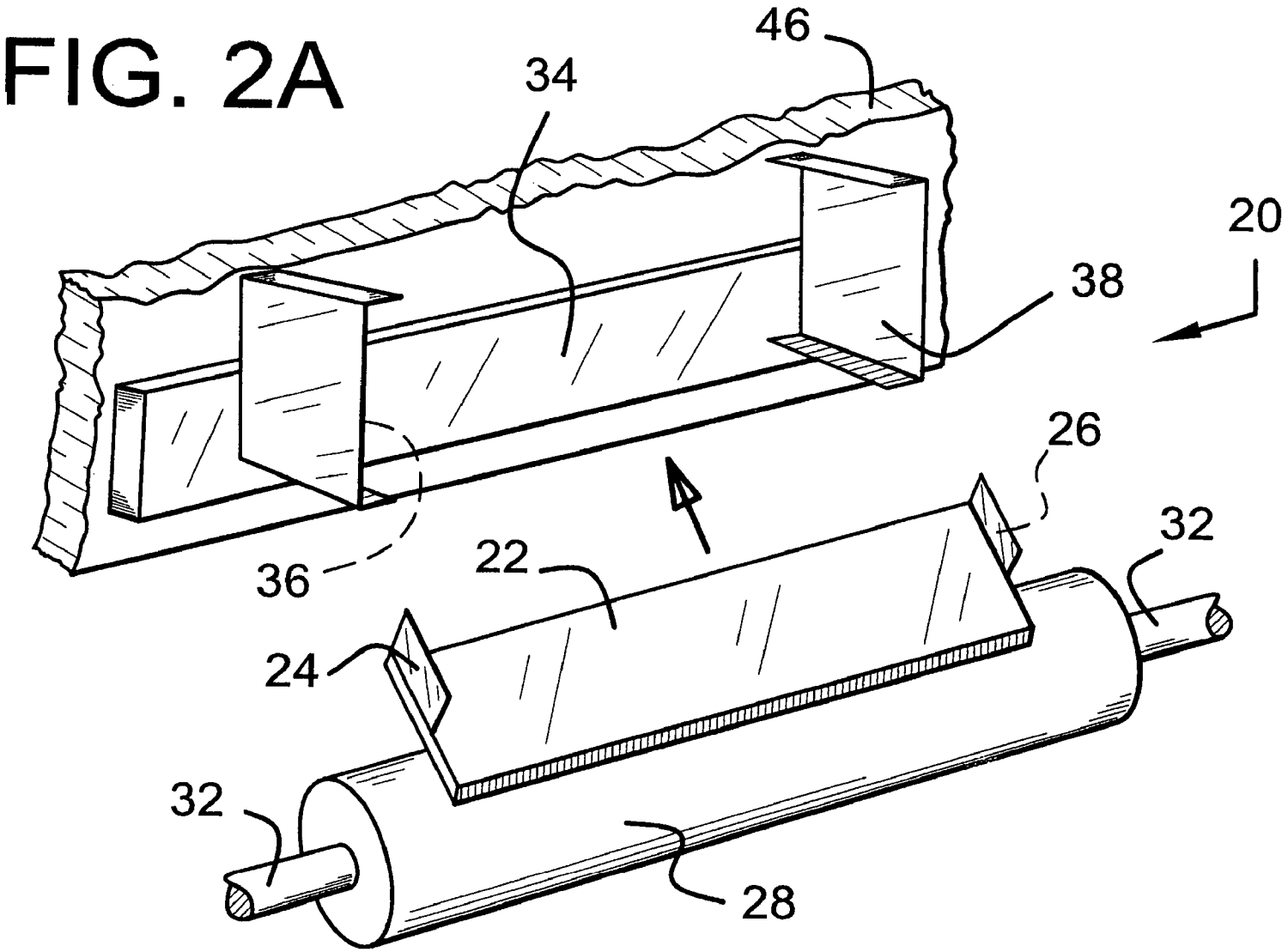
FIG. 2A is a perspective view of a first embodiment of the vehicular, powered slider drive interface in accordance with FIG. 1.
Figure 2B:
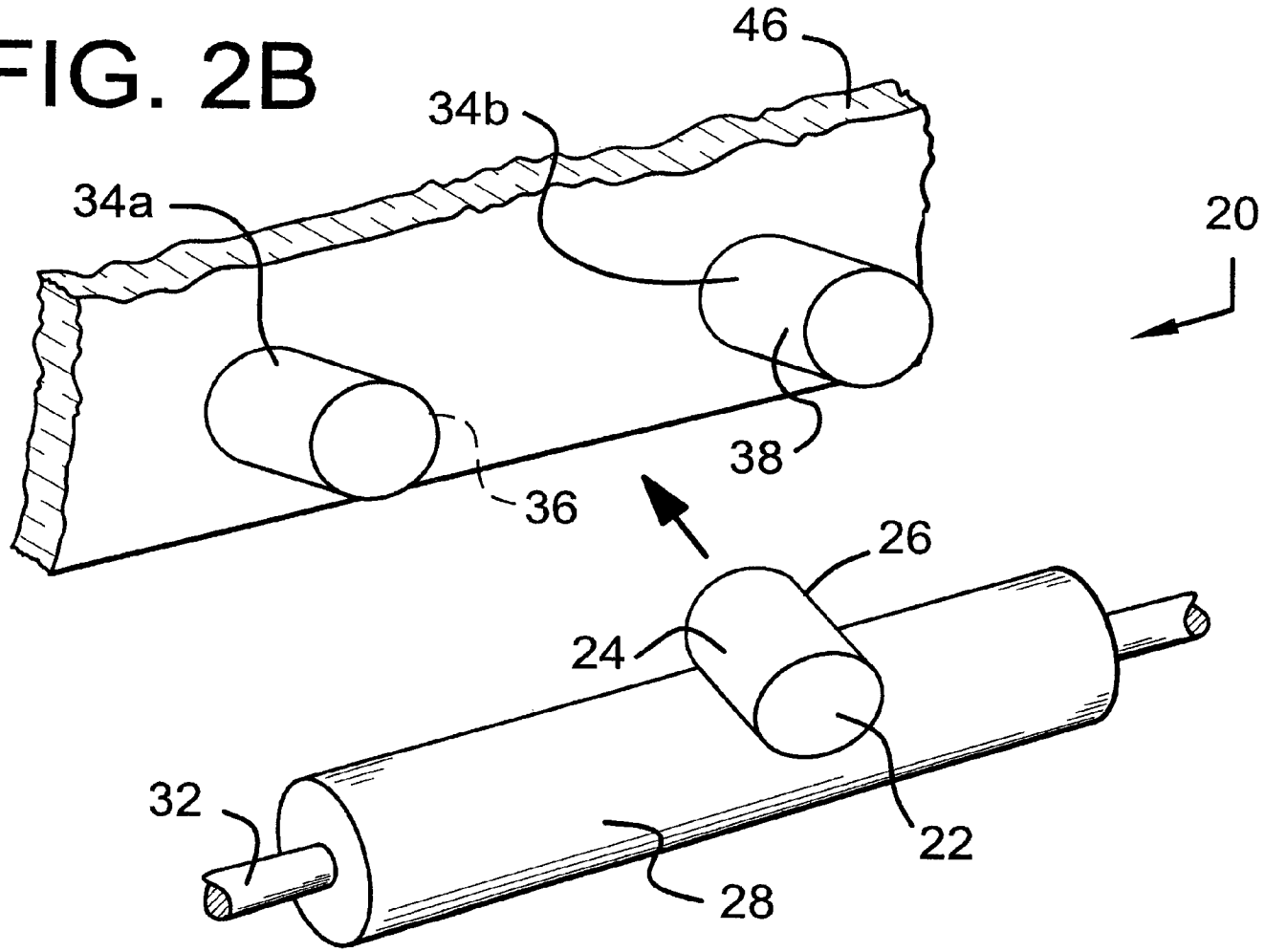
FIG. 2B is a perspective view of a second embodiment of the vehicular, powered slider drive interface in accordance with the present invention.
Figure 2C:
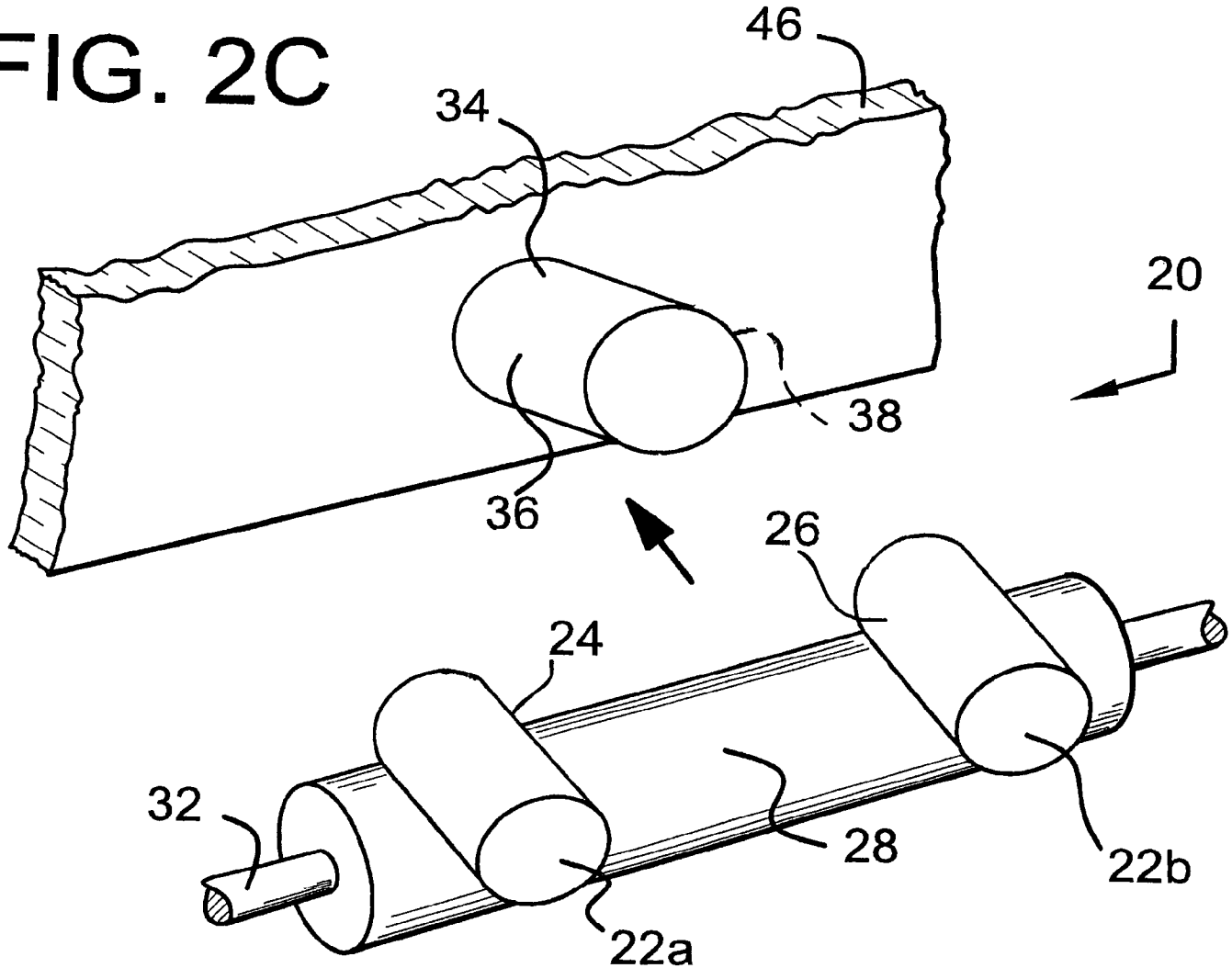
FIG. 2C is a perspective view of a third embodiment of the vehicular, powered slider drive interface in accordance with the present invention.

The present invention provides a vehicular, powered slider drive interface 20 and drive assembly 30, as generally illustrated in FIG. 1. FIG. 2A shows the drive interface 20 of FIG. 1 having a driver bracket 22 that includes at least first and second driver contact surfaces 24 and 26, the driver bracket 22 being mounted on a regulator 28, a driver receiver 34 that includes at least first and second receiver contact surfaces 36 and 38, the receiver 34 being mounted on a slider panel 46, and selectively first and second drive bumpers 42, 44 (shown in FIG. 1), respectively covering receiver contact surfaces 36, 38. Widths of the driver bracket 22 and the driver receiver 34 may vary from that shown in FIGS. 1 and 2A, which are on the order of the width of the slider panel 46, to narrower widths, as shown in FIGS. 2B and 2C.

As shown in FIGS. 1, 2A-2C, and 4, at least one end of cable 32 is attached to the regulator 28, wherein the cable 32 is in mechanical communication with a powered slider controller (not shown). If the cable is moved in a first direction, for example, open, then the slider panel 46 is commanded to smoothly slide open. If the cable is moved in an opposite second direction, for example, closed, then the slider panel 46 is commanded to smoothly slide closed.

The cable 32 communicates a direction that is commanded by the powered slider controller to slidably move the attached regulator 28 within the powered slider frame 31. Note, however, that the regulator 28 could be moved by equivalent means in the art, for example, rack and pinion gears, and still fall within the scope and spirit of the present invention. As shown, the regulator 28, in turn, moves the attached driver bracket 22 in the same direction.

Figure 4:
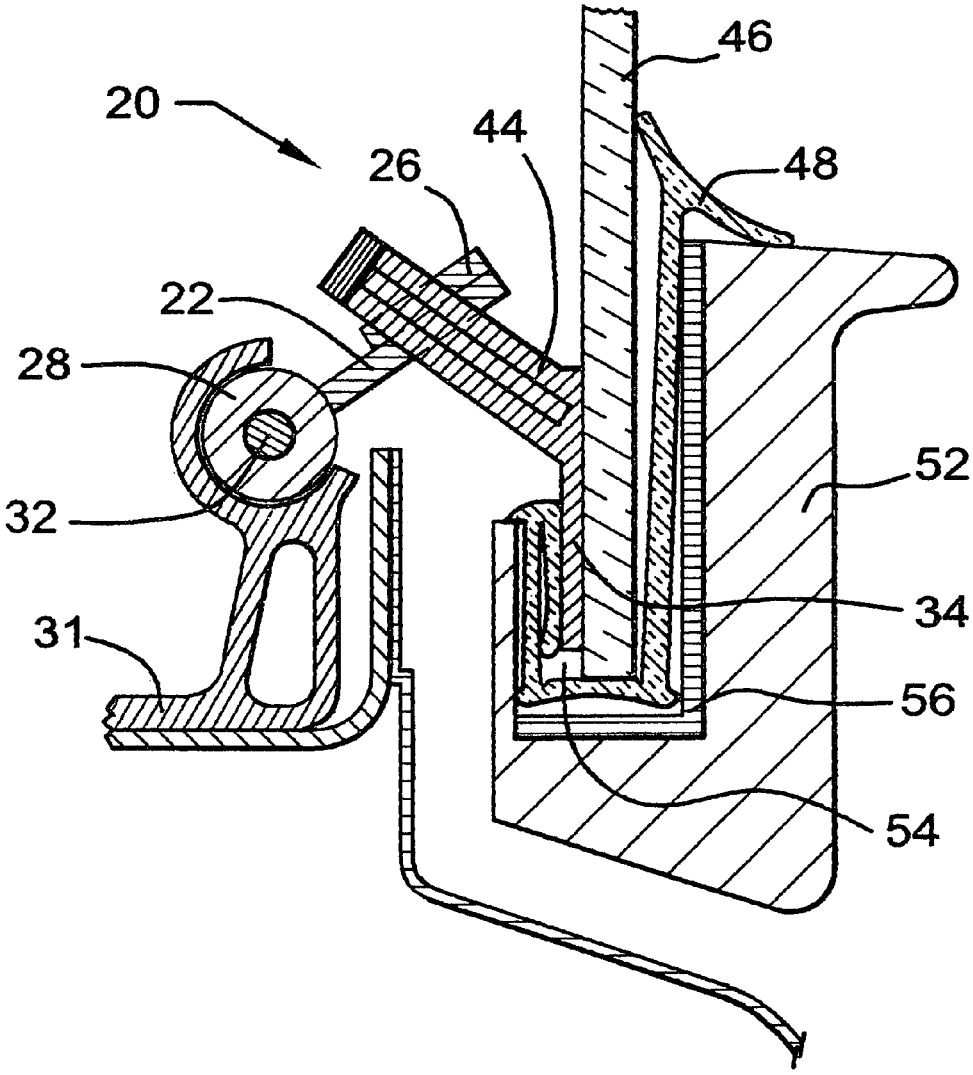
FIG. 4 is a cross-sectional side view of the vehicular, powered slider drive interface and drive assembly taken along an orthogonal line cutting through a second drive bumper in accordance with FIG. 1.

A slider panel assembly 40 is provided that includes the driver receiver 34 with receiver contact surfaces 36, 38 (with or without drive bumpers 42, 44) disposed on the slider panel 46, which is disposed in a lower slider track 54 and upper slider track (not shown) and encapsulated by a seal 48 that prevents, for example, moisture and dirt, from reaching the slider tracks. A panel frame 56 encases the slider panel assembly 40 (note that FIG. 4 shows only a lower portion of the assembly 40), wherein the frame 56 is disposed in a vehicle body 52.

As shown in FIG. 1, the interface between the driver contact surfaces 24, 26 and the receiver contact surfaces 36, 38 is not a rigid attachment, as in U.S. Pat. Nos. 6,119,401 to Lin et al. and 6,324,788 to Koneval et al. Also, the driver bracket 22 is free to move between a portion of the space between each of the receiver contact surfaces 36, 38, wherein one of the driver contact surfaces 24, 26 will make selectively non-attached pushing or pulling mechanical contact with its corresponding receiver contact surface 36, 38. This contact allows for substantial misalignment, for example, between the regulator 28 and the slider panel 46, since varying portions of the driver contact surfaces 24, 26 and the receiver contact surfaces 36, 38 can make contact with each other.

Note that the misalignment may exist at the time of manufacturing, during assembly, or in the normal use of the slider panel assembly 40. Also, note that the portions of the driver contact surfaces 24, 26 and/or the receiver contact surfaces 36, 38 may vary as conditions, for example, wear, temperature, and moisture, change for the slider panel assembly 40.

It should be appreciated that the driver contact surfaces 24, 26, as shown in FIG. 2A, could be positioned outside of the receiver 34 and then the reverse side of the driver contact surfaces 24, 26 would make selectively non-attached pushing or pulling mechanical contact on the surfaces on the reverse side of the receiver contact surfaces 36, 38.

In either configuration (i.e., the driver contact surfaces 24, 26 being positioned inside or outside of the receiver contact surfaces 36, 38), the driver bracket 22 causes sliding motion of the driver receiver 34 and the attached sliding panel 46. If desired, the receiver contact surfaces 36, 38 may have first and second drive bumpers 42, 44 disposed on them, so as to cushion the mechanical impact forces that would be applied to the receiver contact surfaces 36, 38 by the mechanical contact from the driver contact surfaces 24, 26. The bumpers 42, 44 may also lower the level of sound that would be generated by the driver contact surfaces 24, 26 as they make contact with the receiver contact surfaces 36, 38.

A second embodiment of the present invention is illustrated in FIG. 2B where the driver is a single driver stop 22 disposed on the regulator 28, the driver stop 22 having driver contact surfaces 24, 26, the receiver comprises separate receiver stops 34*a*, 34*b* that are disposed on the slider panel 46, and the receiver stops 34*a*, 34*b* respectively having receiver contact surfaces 36, 38. Note that the stops 22, 34*a*, 34*b* are not limited by their shapes.

A third embodiment of the present invention is illustrated in FIG. 2C where the driver comprises two driver stops 22*a*, 22*b* that are disposed on the regulator 28, the driver stops 22*a*, 22*b* respectively having driver contact surfaces 24, 26, the receiver is a single receiver stop 34 disposed on the slider panel 46, and the receiver stop 34 having receiver contact surfaces 36, 38. Note that the stops 22, 22*a*, 22*b*, 34, 34*a*, 34*b* (of FIGS. 2A-2C) are not limited by their shapes. It should also be noted that the drivers 22, 22*a*, 22*b* and the slider receivers 34, 34*a*, 34*b* may be, respectively, indirectly attached to the regulator 28 or slider panel 46 and still fall within the scope and spirit of the present invention.

Figure 3:
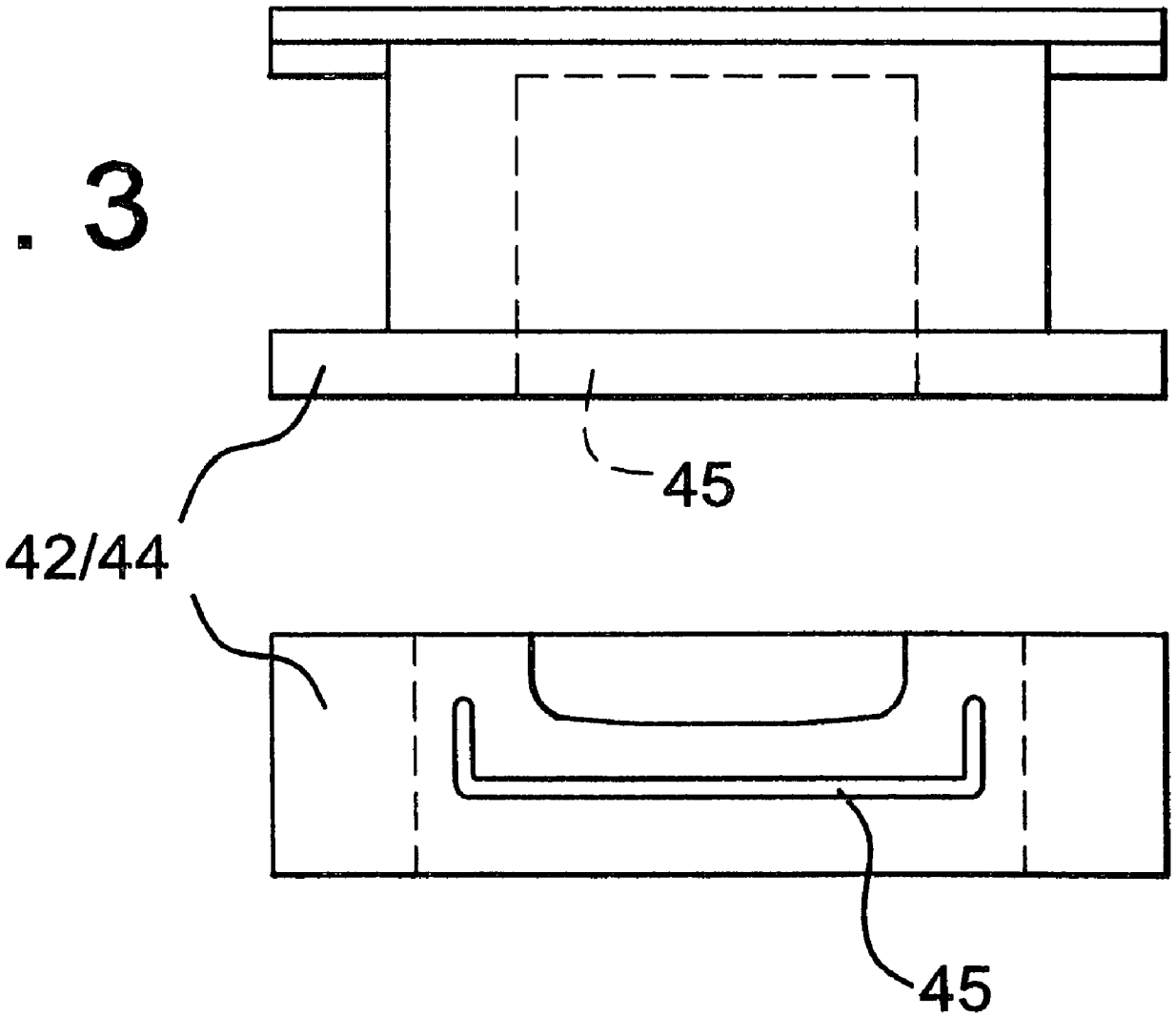
FIG. 3 is a plan view and an end-on view of a drive bumper in accordance with FIG. 1.

As illustrated in FIG. 3, the bumpers 42, 44 have a bumper slot 45 formed therein. The bumpers 42, 44 would be disposed over the corresponding contact surfaces 36, 38 by way of the slot 45, whose shape and depth would be in cooperation with the shape and depth of the stops associated with the contact surfaces 36, 38. Individually the contact surfaces 24, 26, the contact surfaces 36, 38, and the bumpers 42, 44 may be made of metal, rubber, plastic, or other suitable material.

Examples of suitable plastic materials are ethylene propylene diene monomer (EPDM), flexible polyvinyl chloride, urethane, or any combination thereof. Although not shown, bumpers of cooperating shape and size, and of suitable material could be applied to-the receivers 34, 34*a*, and 34*b*of FIGS. 2B and 2C. As a consequence of its physical design and the choice of material, the driver receivers 34, 34*a*, or 34*b* cause smooth sliding motion of the slider panel 46 in the slider panel assembly 40.

FIG. 4 shows a cross-sectional side view of the powered slider drive interface 20 taken along an orthogonal line cutting through the second drive bumper 44 of FIG. 1. Also shown are examples of various parts of the powered slider drive 30 and slider panel assembly 40. It may be further appreciated that the present invention, however, is not limited by and may be exercised by varying configurations of these assemblies 30, 40. Further, the vehicle powered slider drive interface 20 of the present invention may be utilized for any vehicle sliding window panel assembly.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A powered slider drive interface for opening and closing a vehicle slider panel across a window aperture, comprising:

a slider panel;

a regulator;

at least first and second mechanical stops mounted on the slider panel or the regulator, both first and second stops having a contact surface; and one or more mechanical stops mounted on the other of the slider panel or the regulator, the one or more stops having third and fourth contact surfaces;

wherein when the regulator is caused to move in a first direction the first stop contact surface is brought into mechanical contact with the third contact surface, thus urging the slider panel into an open position at which there is a space between the second stop contact surface and the fourth stop contact surface;

further wherein when the regulator is caused to move in a second direction, the second stop contact surface is brought into mechanical contact with the fourth contact surface, thus urging the slider panel into a closed position at which there is a space between the first stop contact surface and the third stop contact surface.

2. The powered slider drive interface of claim 1, wherein the first and second mechanical stops are oppositely inclined to the third and fourth stops and the mechanical contacts are selectively non-attached pushing or pulling mechanical contacts, thus allowing the slider panel to freely slide without binding and requiring precise alignment between the regulator and the slider panel.

3. The powered slider drive interface of claim 1, wherein separate drive bumpers are disposed on each of the slider panel stops.

4. The powered slider drive interface of claim 3, wherein the composition of the drive bumpers, contact surfaces, or stops, comprises plastic.

5. The powered slider drive interface of claim 4, wherein the plastic is selected from the group consisting of ethylene propylene diene monomer, flexible polyvinyl chloride, and urethane, or any combination thereof.

6. A powered slider drive interface for opening and closing a vehicle slider panel across a window aperture, comprising:

a driver bracket including at least first and second contact surfaces, the driver bracket being disposed on a regulator; and a driver receiver including at least two stops, each having a contact surface, the driver receiver being disposed on the slider panel;

wherein when the regulator is caused to move in a first direction, the bracket first contact surface is brought into mechanical contact with the first receiver contact surface, thus urging the slider panel into an open position at which there is a space between the bracket second contact surface and the second receiver contact surface; and further wherein when the regulator is caused to move in a second direction, the bracket second contact surface is brought into mechanical contact with the second receiver contact surface, thus urging the slider panel into a closed position at which there is a space between the bracket first contact surface and the first receiver contact surface.

7. A powered slider drive assembly for opening and closing a vehicle slider panel across a window aperture, comprising:

a driver bracket including at least a first contact surface and a second contact surface, the driver bracket being disposed on a regulator having a cable attached thereto, and the regulator being disposed on a powered slider frame; and a driver receiver including at least a first receiver stop and a second receiver stop, each having a contact surface, the driver receiver being disposed on the slider panel that is disposed in slider tracks which are positioned above and below the slider panel;

wherein when a powered slider controller urges the cable into a first direction, the first driver bracket contact surface is brought into mechanical contact with the first receiver contact surface, thus urging the slider panel in the slider tracks and opening at least a portion of the window aperture at which there is a space between the second driver bracket contact surface and the second receiver contact surface;

further wherein when the powered slider controller urges the cable into a second direction, the second driver bracket contact surface is brought into mechanical contact with the second receiver contact surface, thus urging the slider panel in the slider tracks and closing at least a portion of the window aperture at which there is a space between the first driver bracket contact surface and the first receiver contact surface.

8. The powered slider drive assembly of claim 7, wherein mechanical contacts between the bracket contact surfaces and receiver stops contact surfaces are selectively non-attached pushing or pulling mechanical contacts and the driver bracket and driver receiver are oppositely inclined to one another, thus allowing the slider panel to freely slide without binding and requiring precise alignment between the regulator and the slider panel.

9. The powered slider drive assembly of claim 7, wherein separate drive bumpers are disposed on each of the receiver stops.

10. The powered slider drive interface of claim 9, wherein the composition of the drive bumpers, contact surfaces, or receiver stops, comprises plastic.

11. The powered slider drive interface of claim 10, wherein the plastic is selected from the group consisting of ethylene propylene diene monomer, flexible polyvinyl chloride, and urethane, or any combination thereof.

12. A slider panel assembly, comprising:

a slider panel having a horizontal slider panel edge; and a driver receiver including at least two receiver stops, the receiver stops being spaced apart from each other, each receiver stop having a contact surface, and the driver receiver being disposed on the slider panel and parallel to the horizontal slider panel edge;

wherein when a first external contact surface is brought into mechanical contact with the first receiver stop contact surface there is a space between a second external contact surface and the second receiver contact surface, and when the second external contact surface is brought into mechanical contact with the second receiver contact surface there is a space between the first external contact surface and the first receiver contact surface, thus the slider panel is capable of horizontally opening and closing a window aperture in a vehicle backlite.

13. The slider panel assembly of claim 12, further comprising separate bumpers disposed on each of the receiver stops.

14. A powered slider drive interface for opening and closing a vehicle slider panel across a vehicle backlite window aperture, comprising:

a slider panel;

a regulator;

a first slider panel stop having a first contact surface and a second slider panel stop having a second contact surface, each slider panel stop mounted on the slider panel; and a regulator stop having a third and a fourth contact surface, the regulator stop mounted on the regulator;

wherein when the regulator is urged horizontally in a first direction, the first stop contact surface is brought into mechanical contact with the third contact surface and there is a space between the second stop contact surface and the fourth stop contact surface, thereby opening a vehicle backlite window aperture;

further wherein when the regulator is urged horizontally in a second direction, the second stop contact surface is brought into mechanical contact with the fourth contact surface and there is a space between the first stop contact surface and the third stop contact surface, thereby closing a vehicle backlite window aperture.

15. The powered slider drive interface of claim 14, further comprising:

a cable attached to the regulator, the regulator being disposed on a powered slider frame; and upper and lower slider tracks, the upper slider track positioned above the slider panel and the lower slider track positioned below the slider panel, the slider panel being disposed in the slider tracks.

16. The powered slider drive interface of claim 15, further comprising a powered slider controller for urging the cable to horizontally open and close the vehicle backlite window aperture.

* * * * *